US008016614B2

(12) United States Patent
Xie et al.

(10) Patent No.: US 8,016,614 B2
(45) Date of Patent: Sep. 13, 2011

(54) RF COAXIAL CONNECTOR

(75) Inventors: Guangrong Xie, Shanghai (CN); Claude Brocheton, Shanghai (CN)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 12/995,839

(22) PCT Filed: Jul. 22, 2009

(86) PCT No.: PCT/IB2009/053190

§ 371 (c)(1),
(2), (4) Date: Jan. 24, 2011

(87) PCT Pub. No.: WO2010/010524

PCT Pub. Date: Jan. 28, 2010

(65) Prior Publication Data

US 2011/0117778 A1 May 19, 2011

(30) Foreign Application Priority Data

Jul. 22, 2008 (CN) ..... 2008 1 0040848

(51) Int. Cl.
*H01R 9/05* (2006.01)

(52) U.S. Cl. ..... 439/578; 439/63

(58) Field of Classification Search ..... 439/63, 439/578–585

See application file for complete search history.

(56) References Cited

U.S. PATENT DOCUMENTS 5,474,470 A 12/1995 Hammond, Jr.

FOREIGN PATENT DOCUMENTS

WO WO 98/16971 4/1998

OTHER PUBLICATIONS

International Search Report mailed Oct. 29, 2009 issued in International Patent Application No. PCT/IB2009/053190.

*Primary Examiner* — Khiem Nguyen
(74) *Attorney, Agent, or Firm* — Oliff & Berridge, PLC

(57) ABSTRACT

The invention discloses a RF coaxial connector, which includes a socket and an adapter. The socket includes an outer conductor and a center conductor. The adapter includes a plug capable of being inserted into the socket. The adapter also includes an outer conductor and a center conductor that can be in contact with the outer conductor and the center conductor of the socket, respectively. A dumbbell-shaped first insulating body is disposed inside the plug of the adapter and filled between the outer conductor and the center conductor of the adapter. The first insulating body has a middle portion narrower than two end portions thereof such that an annular gap is formed between the middle portion of the first insulating body and the outer conductor of the adapter, thereby forming different impedance regions at the connection regions of the plug and the socket. Therefore, a high impedance region and a low impedance region can compensate each other so as to decrease the adverse effect of the high impedance region on the connector performance and improve electrical and RF performance of the product. Compared with the prior art, the connector of the present invention allows a larger axial offset.

15 Claims, 4 Drawing Sheets

RF COAXIAL CONNECTOR

BACKGROUND OF THE INVENTION

1. Field of the Invention

The present invention relates to a RF coaxial connector.

2. Description of Related Art

RF coaxial connectors are used for providing interconnection between circuit boards, between RF modules, or between circuit boards and RF modules. In these applications, the allowable tolerance between relative positions of two connected elements tends to increase so as to facilitate fabrication of the elements and reduce the fabrication cost.

Currently, there are several circuit board interconnection techniques that allow axial and radial offsets between circuit boards. The oldest technique is based on standard snap-on connectors, such as SMB and MCX connectors, which have sockets and plugs for interconnecting the circuit boards. As shown in FIG. 1, in such a connector, inner conductors and outer conductors thereof have a staggered pin and insertion hole arrangement, which allows a limited axial offset. Since the elastic insertion holes of the inner and outer conductors only can tolerate extremely small axial and radial offsets, the number of the connectors disposed to a circuit board is not more than three pairs. In order to overcome the drawback, a second circuit board interconnection technique uses an adapter as an intermediate connection element, such as MMBX and SMP series on the market. The adapter can have a small rotation relative to a socket fixed to a circuit board, thereby allowing a radial offset of $L \sin(\alpha)$. Therein, L is the length of the adapter and $\alpha$ is the rotational angle of the adapter. As shown in FIG. 2, the axial offset and the radial offset angle of a SMP connector with the maximum board-to-board distance H are ±0.3 mm and ±4°, respectively, and the axial offset and radial offset angle of a MMBX connector is ±0.70 mm and ±4.5°, respectively. The RF electrical performance of the above-described connectors depends on the degree of impedance match at the interconnection interface of the connectors. An air gap at the connection interface leads to high impedance of the region.

In addition, in order to ensure a sufficiently large offset angle in the case of a minimum tolerance along the axial distance H, the joining distance between the pins and insertion holes of the center conductors must be as small as possible such that over-stress does not occur when the center conductors have an angle offset, which however limits the increase of the axial offset of the connectors with the board-to-board distance H.

SUMMARY OF THE INVENTION

According to the above drawback, exemplary embodiments of the present invention provide a RF coaxial connector that allows a larger axial offset and achieves superior RF electrical performance.

Exemplary embodiments of the present invention provide a RF coaxial connector, which comprises a socket and an adapter. The socket may comprise an outer conductor and a center conductor. The adapter may comprise a plug capable of being inserted into the socket. The adapter may further comprise an outer conductor and a center conductor that are configured to be in contact with the outer conductor and the center conductor of the socket, respectively. A dumbbell-shaped first insulating body may be disposed inside the plug of the adapter and filled between the outer conductor and the center conductor of the adapter, and the first insulating body may comprise two end portions and a middle portion narrower than the two end portions, thereby forming an annular gap between the middle portion of the first insulating body and the outer conductor of the adapter.

Such a dumbbell-shaped first insulating portion may enable an impedance compensation effect to be achieved when the air-gap at the connection interface varies, the variation of the air-gap lying for instance between 0 and 2 mm.

The impedance associated with a first insulating body as provided by exemplary embodiments of the invention may be much smaller than 50Ω.

The first insulating body may extend along a longitudinal axis and may optionally have a midplane perpendicular to said longitudinal axis.

The first end portion of the first insulating body faces the socket when the plug is inserted into the socket and may have an impedance value less than 50Ω, lying for instance between 40Ω and 49Ω, in particular between 48Ω and 49Ω.

The impedance value of the middle portion of the first insulating body may be substantially equal to 50Ω.

In an exemplary embodiment of the invention, the first end portion of the first insulating body has an impedance value less than 50Ω, lying for instance between 48Ω and 49Ω, and the middle portion and the second end portion of the first insulating body that is away from the socket when the plug is inserted in said socket have an impedance value of around 50Ω. Said second end portion may have an impedance value varying slightly from 50Ω based on a function of the diameter of the outer and/or center conductor.

Each end portion of the first insulating body may optionally extend over substantially equal lengths along the longitudinal axis of the first insulating body.

The ratio between the length of the middle portion of the first insulating body and the length of an end portion of said first insulating body, for example the first end portion, lies between 2 to 10, in particular 3 to 7.

The first end portion and the middle portion of the first insulating body may have the same inner diameter.

The second end portion of the first insulating body may have an inner diameter smaller than the inner diameter of the middle portion, which enables said second end portion to receive the portion of the center conductor having a smaller outer diameter.

The first insulating body may not extend axially beyond the outer conductor of the plug, which may prevent the first insulating body from abutting a surface of the socket, thereby protecting the first insulating body.

The second end portion of the first insulating body may be entirely within the outer conductor of the plug, enabling for instance protection of the center conductor against excessive radial forces The center conductor of the plug may extend along both of the end portions of the first insulating body and along the middle portion of said first insulating body.

The center conductor may not extend beyond the first insulating body toward the socket.

The outer conductor of the socket may comprise a tubular position defining an inner hole. A shoulder portion may be disposed inside the inner hole of the outer conductor of the socket and extending towards the center of the inner hole.

Further, a second insulating body may be disposed to the rear end of the socket and filled between the outer conductor and the center conductor of the socket, wherein the front end surface of the second insulating body may be flush with the front end surface of the shoulder portion.

In exemplary embodiments of the invention, the diameter B of the inner hole of the outer conductor of the socket is 3.65-4.05 mm, the depth I of the inner hole of the outer conductor of the socket is 2.3-3.3 mm, the diameter G of the inner hole of the shoulder portion is 2.3-2.7 mm, the width E of the shoulder portion is 0.2-0.6 mm, the diameter A of the center conductor of the socket is 0.66-1.06 mm, the inner diameter D of the outer conductor of the adapter is 3.0-3.4 mm, the outer diameter C of the inner conductor of the adapter is 1.07-1.47 mm, the width F of the end portions of the first insulating body is 0.6-1.0 mm, and the outer diameter J of the middle portion of the first insulating body is 1.6-2.0 mm.

In particular, the diameter B of the inner hole of the outer conductor of the socket may be 3.85 mm, the depth I of the inner hole of the outer conductor of the socket may be 2.8 mm, the diameter G of the inner hole of the shoulder portion may be 2.5 mm, the width E of the shoulder portion may be 0.4 mm, the diameter A of the center conductor of the socket may be 0.86 mm, the inner diameter D of the outer conductor of the adapter may be 3.2 mm, the outer diameter C of the inner conductor of the adapter may be 1.27 mm, the width F of the end portions of the first insulating body may be 0.8 mm, and the outer diameter J of the middle portion of the first insulating body may be 1.8 mm.

The present invention may achieve following advantageous effects. When the dumbbell-shaped first insulating body is disposed inside the plug of the adapter, different impedance regions may be formed at the connection regions of the plug and the socket. If a large axial offset distance exists between the connecting elements, a large air gap may appear at the connection interface, thereby forming a high impedance region. Meanwhile, an end portion of the first insulating body may form a low impedance region and an annular gap between the middle portion of the first insulating body and the outer conductor of the adapter may form a normal impedance region. Because the high impedance region and the low impedance region may compensate each other, the adverse effect of the high impedance region to the connector performance may be decreased and the electrical and RF performance of the product may be improved. Therefore, compared with the prior art, the RF coaxial connector of the present invention may allow a larger axial offset (>1 mm), reduce the impedance mismatch caused by the air gap at the connection interface, and achieve preferred RF electrical performance over a frequency range from 0 to 6 GHz.

A low impedance region may also be formed at the shoulder portion region. Thus, the low impedance regions may be formed at both sides of the high impedance region, thereby enhancing the compensation effect.

DETAILED DESCRIPTION OF PREFERRED EMBODIMENTS

The following illustrative embodiments are provided to illustrate the disclosure of the present invention, these and other advantages and effects may be apparent to those skilled in the art after reading the disclosure of this specification.

Figure 1:
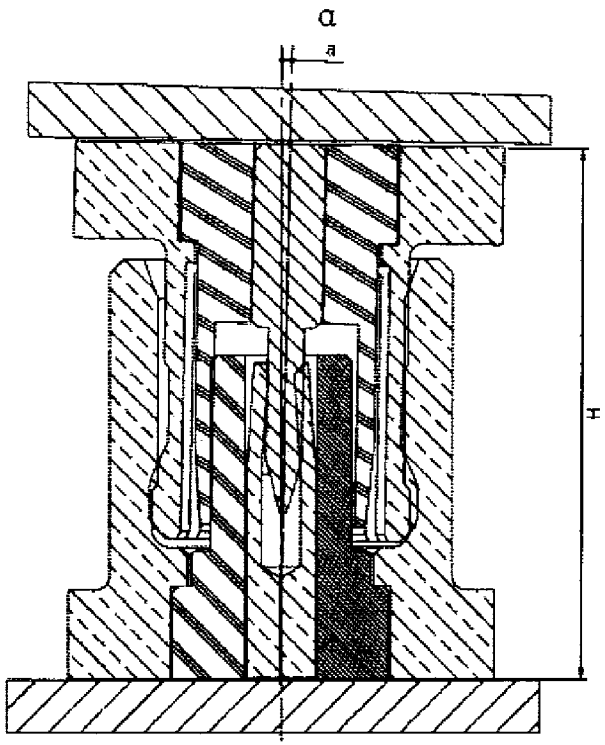
FIG. 1 shows the structure of a conventional snap-on coaxial connector.
Figure 2:
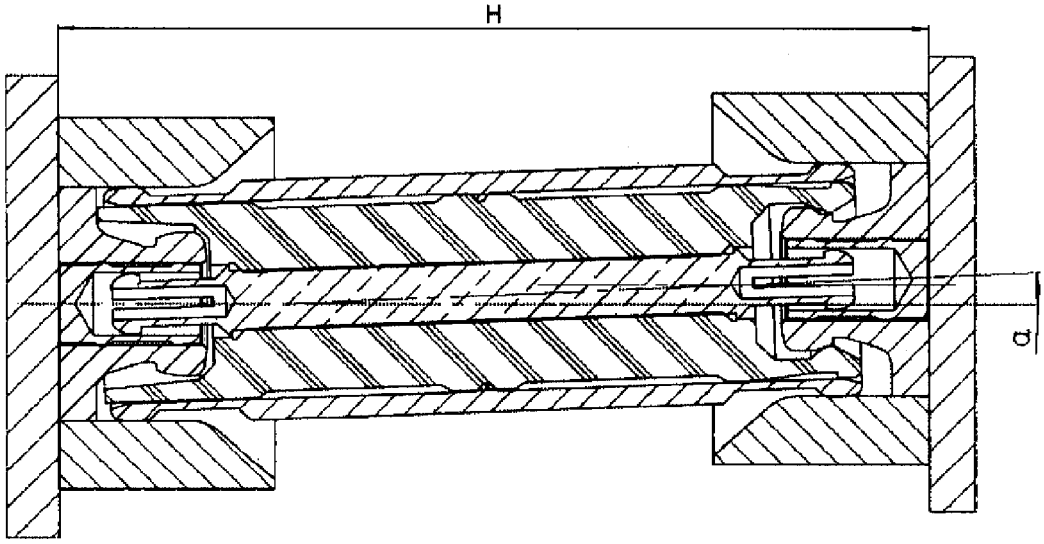
FIG. 2 shows the structure of a conventional coaxial connector with an adapter.
Figure 3:
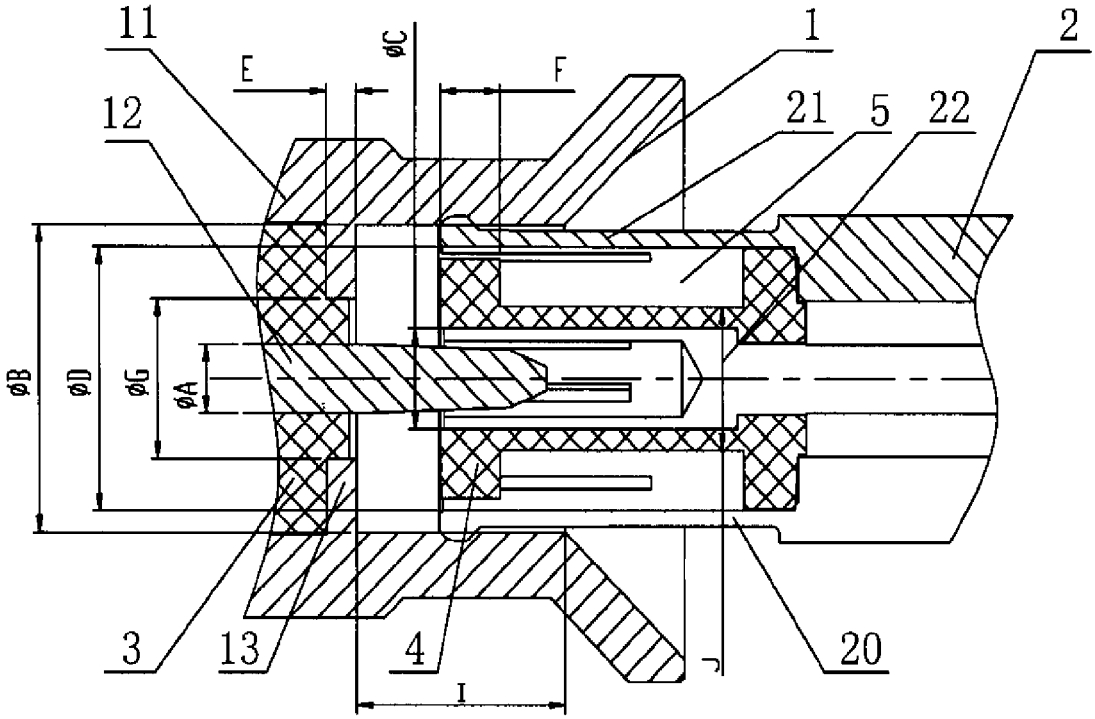
FIG. 3 shows the structure of a coaxial connector according to the present invention.

As shown in FIG. 3, a RF coaxial connector according to exemplary embodiments of the present invention comprises a socket 1 and an adapter 2. The socket 1 comprises an outer conductor 11 and a center conductor 12. The adapter 2 comprises a plug 20 disposed at one end thereof and capable of being inserted into the socket 1. The adapter 2 further comprises an outer conductor 21 and a center conductor 22. When the plug 20 is inserted into the socket 1, the outer conductor 21 and center conductor 22 of the adapter 2 are in contact with the outer conductor 11 and center conductor 12 of the socket 1, respectively.

Figure 4:
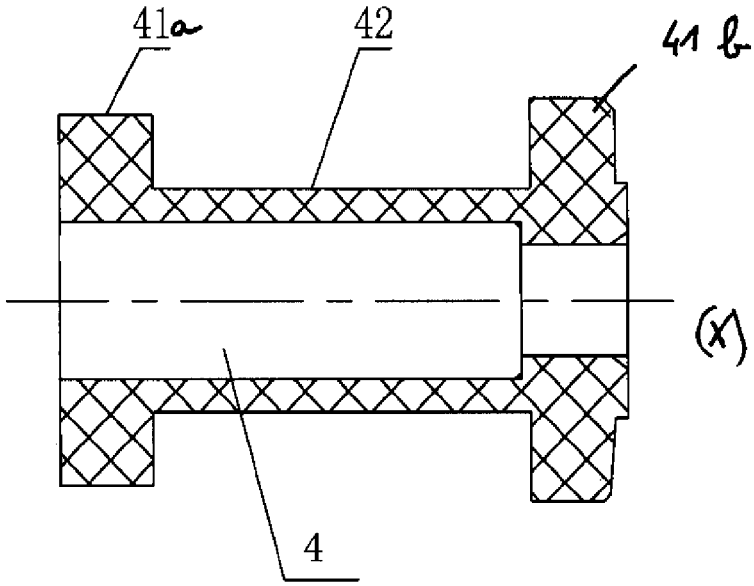
FIG. 4 shows the structure of a first insulating body according to the present invention.
Figure 5:
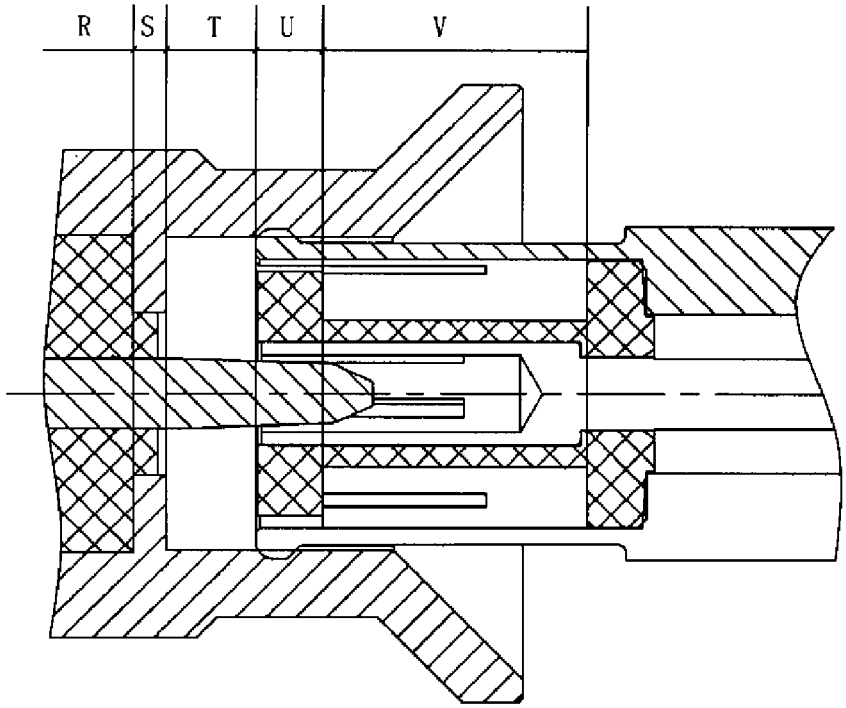
FIG. 5 shows regional distribution of different impedance in the coaxial connector according to the present invention.

A dumbbell-shaped first insulating body 4 extending along a longitudinal axis X is disposed inside the plug 20 of the adapter. As shown in FIG. 4, the first insulating body 4 comprises a first end portion 41*a* and a second end portion 41*b* and a middle portion 42 narrower than the two end portions 41*a* and 41*b*. The first insulating body 4 is filled between the outer conductor 21 and the center conductor 22 of the socket such that an annular gap 5 is formed between the middle portion of the first insulating body and the outer conductor of the adapter, wherein the annular gap 5 forms a normal impedance region (region V of FIG. 5).

A shoulder portion 13 is disposed inside the inner hole of the outer conductor 11 of the socket and extending towards the center of the inner hole. When the plug 20 is inserted into the socket 1, if the end surface of the outer conductor 21 is not closely attached to the front end surface of the shoulder portion 13, an air gap is formed between the shoulder portion 13 and the end surface of the plug (comprising the end surface of the first insulating body 4), wherein the air gap forms a high impedance region (region T of FIG. 5) which adversely affects the connector performance, while the region where an end portion of the first insulating body is located forms a low impedance region (region U of FIG. 5). Since the high impedance region T and the low impedance region U are adjacent to each other, they may compensate each other so as to reduce impedance mismatch and improve connection performance.

Further, a second insulating body 3 is disposed to the rear end of the socket and filled between the outer conductor 11 and the center conductor 12 of the socket. Therein, the front end surface of the second insulating body 3 is flush with the front end surface of the shoulder portion 13. Thus, a normal impedance region (region R of FIG. 5) is formed at the end portion of the socket between the outer conductor 11 and the center conductor 12, and a low impedance region (region S of FIG. 5) is formed between the inner hole of the shoulder portion 13 and the center conductor 12. Since the low impedance region S is also adjacent to the high impedance region T, they may compensate each other so as to improve the connection performance. That is, if there exists a larger axial offset between the interconnection elements, the high impedance region T formed by the air gap at the connection interface may be compensated or offset by the low impedance regions S, U adjacent thereto, thereby improving impedance match and connection performance of the connector in the case of a larger axial offset. The above-described R, S, T, U, V denote axial ranges of the different impedance regions. Radial ranges of the impedance regions are located between the outer conductors and inner conductors.

In order to achieve a preferred impedance match performance, parameters such as the outer diameter A of the center conductor of the socket, the diameter B of the inner hole of the outer conductor of the socket, the outer diameter C of the insertion hole of the center conductor of the adapter, the diameter D of the inner hole of the outer conductor of the adapter, the width E of the shoulder portion, the width F of the end portions of the first insulating body and the diameter G of the inner hole of the shoulder portion and width H may be optimized. The impedance value of the high impedance region may be determined once the diameter B of the inner hole of the outer conductor of the socket and the outer diameter A of the inner conductor of the socket are determined, and the high impedance region presents an inductive impedance. The optimized parameters are for example as follows: the diameter B of the inner hole of the outer conductor of the socket is 3.65-4.05 mm, the depth I of the inner hole of the outer conductor of the socket is 2.3-3.3 mm, the diameter G of the inner hole of the shoulder portion is 2.3-2.7 mm, the width E of the shoulder portion is 0.2-0.6 mm, the diameter A of the center conductor of the socket is 0.66-1.06 mm, the inner diameter D of the outer conductor of the adapter is 3.0-3.4 mm, the outer diameter C of the inner conductor of the adapter is 1.07-1.47 mm, the width F of the end portions of the first insulating body is 0.6-1.0 mm, the outer diameter J of the middle portion of the first insulating body is 1.6-2.0 mm. When the high and low impedance regions have different lengths and shapes and the two low impedance regions (which present capacitive impedance) have different impedance values, the compensation of the capacitive impedance and the inductive impedance of the three impedance regions as well as delay compensation are calculated. Accordingly, when an optimum compensation is reached, the optimized parameters may be obtained from the corresponding lengths and shapes of the impedance regions.

Figure 6:
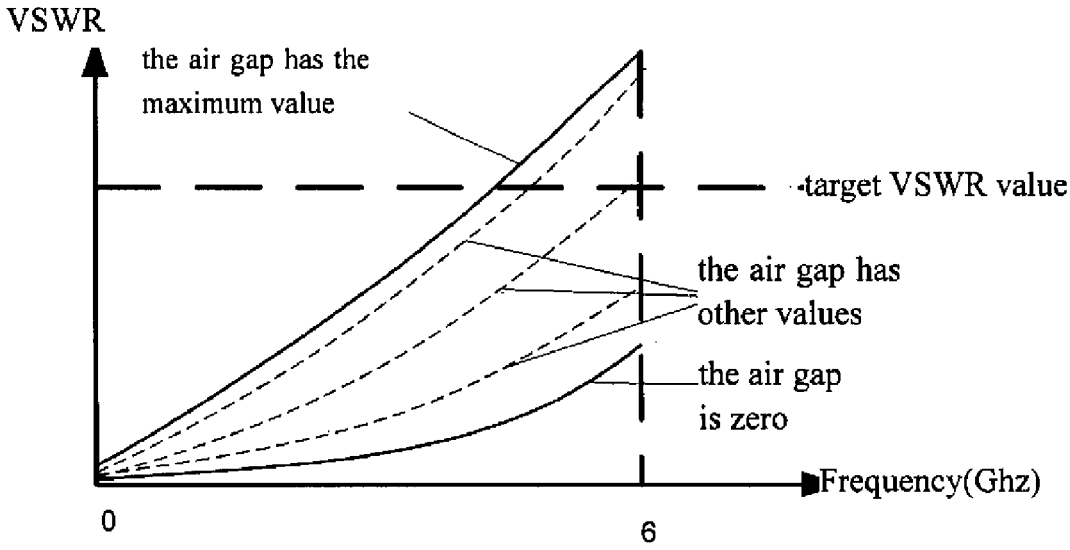
FIG. 6 shows a VSWR (voltage standing wave ratio) curve of a conventional connector.
Figure 7:
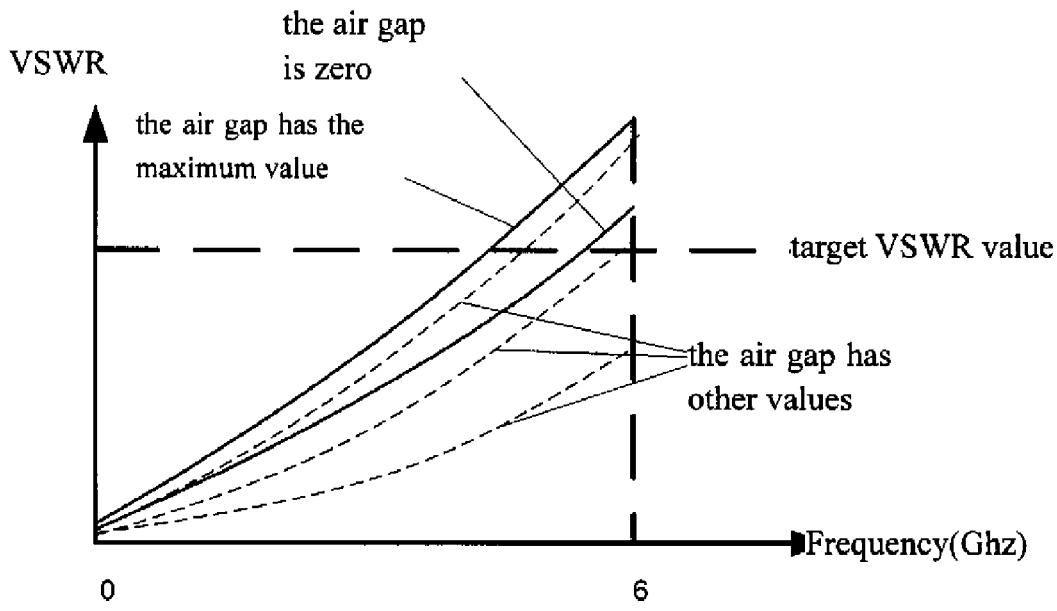
FIG. 7 shows a VSWR curve of the connector according to the present invention (before parameter optimization)
Figure 8:
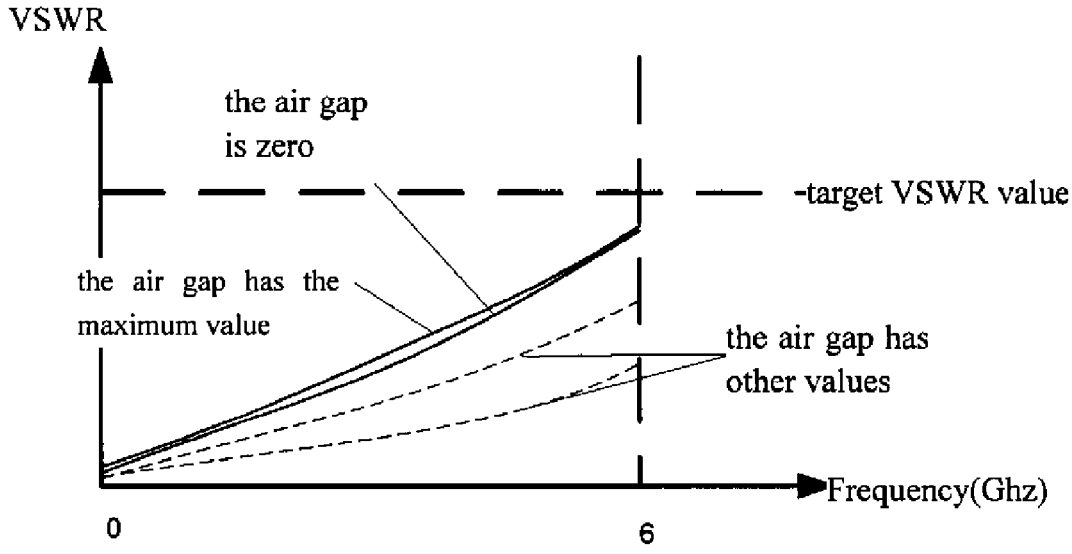
FIG. 8 shows a VSWR curve of the connector according to the present invention (after parameter optimization).

After the parameter optimization, the performance of the connector may be improved significantly. FIG. 6 shows a VSWR (voltage standing wave ratio) curve of a conventional connector. As shown in FIG. 6, when the air gap at the connection interface increases, the VSWRs of the connector also increase and the connection performance of the connector decreases significantly. FIG. 7 shows a VSWR curve of the connector of the present invention before the parameter optimization. As shown in FIG. 7, when the air gap is zero, the VSWRs of the connector increase. FIG. 8 shows a VSWR curve of the connector of the present invention after the parameter optimization, wherein the diameter B of the inner hole of the outer conductor of the socket is for example 3.85 mm, the depth I of the inner hole of the outer conductor of the socket is for example 2.8 mm, the diameter G of the inner hole of the shoulder portion is for example 2.5 mm, the width E of the shoulder portion is for example 0.4 mm, the diameter A of the center conductor of the socket is for example 0.86 mm, the inner diameter D of the outer conductor of the adapter is for example 3.2 mm, the outer diameter C of the inner conductor of the adapter is for example 1.27 mm, the width F of the first insulating body is 0.8 mm, the outer diameter J of the middle portion of the first insulating body is for example 1.8 mm. As shown in FIG. 8, the VSWRs of the connector at same air gaps and frequencies may totally decrease (the connection performance may increase). The VSWRs at two extreme positions (when the air gap is zero and maximum) are close to each other and larger than the VSWRs at other positions, which means a preferred connection performance may be achieved at most of the connection states.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

The invention claimed is:

1. A RF coaxial connector, comprising a socket and an adapter, wherein the socket comprises an outer conductor and a center conductor, the adapter comprises a plug capable of being inserted into the socket, the adapter further comprises an outer conductor and a center conductor that are configured to be respectively in contact with the outer conductor and the center conductor of the socket, the connector comprising:

a dumbbell-shaped first insulating body disposed inside the plug of the adapter and filled between the outer conductor and the center conductor of the adapter, the first insulating body comprising two end portions and a middle portion narrower than the two end portions, thereby forming an annular gap between the middle portion of the first insulating body and the outer conductor of the adapter, the first end portion of the first insulating body facing the socket when the plug is inserted into the socket having an impedance value less than 50Ω.

2. The connector of claim 1, wherein a shoulder portion is disposed inside the inner hole of the outer conductor of the socket and extending towards the center of the inner hole.

3. The connector of claim 2, wherein a second insulating body is disposed to the rear end of the socket and filled between the outer conductor and the center conductor of the socket, the front end surface of the second insulating body being flush with the front end surface of the shoulder portion.

4. The connector of claim 2, wherein the diameter of the inner hole of the outer conductor of the socket is 3.65-4.05 mm, the depth of the inner hole of the outer conductor of the socket is 2.3-3.3 mm, the diameter of the inner hole of the shoulder portion is 2.3-2.7 mm, the width of the shoulder portion is 0.2-0.6 mm, the diameter of the center conductor of the socket is 0.66-1.06 mm, the inner diameter of the outer conductor of the adapter is 3.0-3.4 mm, the outer diameter of the inner conductor of the adapter is 1.07-1.47 mm, the width of the end portions of the first insulating body is 0.6-1.0 mm, and the outer diameter of the middle portion of the first insulating body is 1.6-2.0 mm.

5. The connector of claim 2, wherein the diameter of the inner hole of the outer conductor of the socket is 3.85 the depth of the inner hole of the outer conductor of the socket is 2.8 mm, the diameter of the inner hole of the shoulder portion is 2.5 mm, the width of the shoulder portion is 0.4 mm, the diameter of the center conductor of the socket is 0.86 mm, the inner diameter of the outer conductor of the adapter is 3.2 mm, the outer diameter of the inner conductor of the adapter is 1.27mm, the width of the end portions of the first insulating body is 0.8 mm, and the outer diameter of the middle portion of the first insulating body is 1.8 mm.

6. The connector of claim 1, wherein the first insulating body extends along a longitudinal axis and has a midplane perpendicular to said longitudinal axis.

7. The connector of claim 1, wherein each end portion of the first insulating body extends over a substantially equal length along the longitudinal axis of the first insulating body.

8. The connector of claim l, wherein the ratio between the length of the middle portion of the first insulating body and the length of an end portion of said first insulating body lies between 2 to 10.

9. The connector of claim 1, wherein the first end portion and the middle portion of the first insulating body have the same inner diameter.

10. The connector of claim 1, wherein the second end portion of the first insulating body away from the socket when the plug is inserted into the socket has an inner diameter smaller than the inner diameter of the middle portion.

11. The connector of claim 1, wherein the first insulating body does not extend axially beyond the outer conductor of the plug.

12. The connector of claim 1, wherein the second end portion of the first insulating body is entirely within the outer conductor of the plug.

13. The connector of claim 1, wherein the center conductor of the plug extends along both of the end portions of the first insulating body and along the middle portion of said first insulating body.

14. The connector of any preceding claim 1, wherein the impedance value of the middle portion of the first insulating body is substantially equal to 50Ω.

15. The connector of claim 1, wherein the center conductor does not extend beyond the first insulating body toward the socket.

* * * * *